US009845933B2

(12) United States Patent
Lin et al.

(10) Patent No.: US 9,845,933 B2
(45) Date of Patent: Dec. 19, 2017

(54) ILLUMINATION APPARATUS

(71) Applicant: EPISTAR CORPORATION, Hsinchu (TW)

(72) Inventors: Yao Chiu Lin, Hsinchu (TW); Been-Yu Liaw, Hsinchu (TW); Chih-Ming Wang, Hsinchu (TW); Ming-Chi Hsu, Hsinchu (TW); Yi-Jui Huang, Hsinchu (TW); Tsung-Xian Lee, Hsinchu (TW); Kuang-Ping Chao, Hsinchu (TW); Jhih-Sian Wang, Hsinchu (TW)

(73) Assignee: Epistar Corporation, Hsinchu (TW)

( * ) Notice: Subject to any disclaimer, the term of this patent is extended or adjusted under 35 U.S.C. 154(b) by 0 days.

(21) Appl. No.: 14/921,702

(22) Filed: Oct. 23, 2015

(65) Prior Publication Data

US 2016/0047524 A1 Feb. 18, 2016

Related U.S. Application Data

(63) Continuation of application No. 13/293,427, filed on Nov. 10, 2011, now Pat. No. 9,194,541.

(51) Int. Cl.

| | |
|---|---|
| ***F21V 13/08*** | (2006.01) |
| ***F21V 3/04*** | (2006.01) |
| ***F21V 5/00*** | (2015.01) |
| ***F21V 3/02*** | (2006.01) |
| ***F21V 13/02*** | (2006.01) |
| ***F21V 29/70*** | (2015.01) |

(Continued)

(52) U.S. Cl.

CPC ..... *F21V 3/049* (2013.01); *F21K 9/23* (2016.08); *F21K 9/232* (2016.08); *F21K 9/60* (2016.08); *F21K 9/61* (2016.08); *F21K 9/64* (2016.08); *F21V 3/02* (2013.01); *F21V 3/0409* (2013.01); *F21V 3/0418* (2013.01); *F21V 3/0436* (2013.01); *F21V 3/0472* (2013.01); *F21V 5/008* (2013.01); *F21V 13/02* (2013.01); *F21V 29/70* (2015.01); *F21V 7/0016* (2013.01); *F21V 7/22* (2013.01); *F21Y 2115/10* (2016.08)

(58) Field of Classification Search

CPC ... F21K 9/135; F21K 9/50; F21K 9/52; F21K 9/56; F21V 3/049; F21V 13/02; F21V 3/02; F21V 3/0409; F21V 3/0418; F21V 3/0436; F21V 3/0472; F21V 5/008; F21V 7/22; F21Y 2101/02

See application file for complete search history.

(56) References Cited

U.S. PATENT DOCUMENTS

| | | | |
|---|---|---|---|
| 5,134,550 | A | 7/1992 | Young |
| 5,335,157 | A | 8/1994 | Lyons |

(Continued)

FOREIGN PATENT DOCUMENTS

| | | | |
|---|---|---|---|
| JP | 2006-156187 | A | 6/2006 |
| JP | 2006-313718 | A | 11/2006 |

(Continued)

*Primary Examiner* — Peggy Neils

(74) *Attorney, Agent, or Firm* — Muncy, Geissler, Olds & Lowe, P.C.

(57) ABSTRACT

This disclosure discloses an illumination apparatus. The illumination apparatus comprises a cover comprising a second portion and a first portion, and a light source disposed within the cover. An average thickness of the first portion is greater than that of the second portion.

15 Claims, 17 Drawing Sheets

(51) Int. Cl.

| | |
|---|---|
| ***F21K 9/23*** | (2016.01) |
| ***F21K 9/232*** | (2016.01) |
| ***F21K 9/60*** | (2016.01) |
| ***F21K 9/61*** | (2016.01) |
| ***F21K 9/64*** | (2016.01) |
| *F21V 7/00* | (2006.01) |
| *F21V 7/22* | (2006.01) |
| *F21Y 115/10* | (2016.01) |

(56) References Cited

U.S. PATENT DOCUMENTS

| | | | | |
|---|---|---|---|---|
| 5,481,445 | A | 1/1996 | Sitzema et al. | |
| 5,508,587 | A | 4/1996 | Williams et al. | |
| 5,582,480 | A | 12/1996 | Zwick et al. | |
| 7,588,351 | B2 | 9/2009 | Meyer | |
| 7,946,734 | B2 | 5/2011 | Laporte | |
| 7,976,206 | B2 * | 7/2011 | Wu | F21V 3/02 313/315 |
| 8,282,249 | B2 * | 10/2012 | Liang | F21K 9/135 362/249.02 |
| 8,292,472 | B2 | 10/2012 | Huang | |
| 8,303,139 | B1 | 11/2012 | Ohm | |
| 8,324,790 | B1 | 12/2012 | Hu | |
| 8,461,752 | B2 | 6/2013 | Sanders et al. | |
| 8,541,945 | B2 | 9/2013 | Schwarz | |
| 8,562,161 | B2 | 10/2013 | Tong et al. | |
| 8,567,974 | B2 | 10/2013 | Hoelen et al. | |
| 8,628,220 | B2 | 1/2014 | Boonekamp et al. | |
| 8,641,238 | B2 * | 2/2014 | Chiu | F21V 3/00 362/311.02 |
| 8,684,556 | B2 | 4/2014 | Negley et al. | |
| 8,757,845 | B2 * | 6/2014 | Tseng | H01L 33/58 362/257 |
| 9,255,666 | B2 * | 2/2016 | Yao | F21K 9/135 |
| 2011/0216523 | A1 | 9/2011 | Tong et al. | |
| 2012/0087105 | A1 | 4/2012 | Dai et al. | |
| 2012/0161626 | A1 | 6/2012 | Van de Ven et al. | |
| 2012/0243235 | A1 | 9/2012 | Gao | |
| 2013/0050979 | A1 * | 2/2013 | Van De Ven | F21K 9/56 362/84 |

FOREIGN PATENT DOCUMENTS

| | | | |
|---|---|---|---|
| JP | 2008-251940 | A | 10/2008 |
| JP | 2009-140778 | A | 6/2009 |
| JP | 3163068 | | 9/2010 |
| JP | 2011-142060 | A | 7/2011 |
| JP | 3169376 | | 7/2011 |
| JP | 2012-221847 | A | 11/2012 |
| TW | M375840 | U1 | 3/2010 |
| WO | WO 2009/144963 | A1 | 12/2009 |

* cited by examiner

ILLUMINATION APPARATUS

This application is a Continuation of co-pending application Ser. No. 13/293,427, filed on Nov. 10, 2011, and the content of which is hereby incorporated by reference in its entirety.

BACKGROUND

1. Technical Field

The present disclosure relates to an illumination apparatus and in particular to an illumination apparatus with a cover comprising a protrusion.

2. Description of the Related Art

The light-emitting diodes (LEDs) of the solid-state lighting elements have the characteristics of the low power consumption, low heat generation, long operational life, shockproof, small volume, quick response and good opto-electrical property like light emission with a stable wavelength, so the LEDs have been widely used in household appliances, indicator light of instruments, and opto-electrical products, etc. As the opto-electrical technology develops, the solid-state lighting elements have great progress in the light efficiency, operation life and the brightness, and LEDs are expected to become the main stream of the lighting devices in the near future.

Recently, LEDs have been used for general illumination applications. In some applications, there is a need to have a LEDs lamp with an omni-directional light pattern. However, conventional LEDs lamps are not suitable for this need.

SUMMARY OF THE DISCLOSURE

The present disclosure provides an illumination apparatus.

The illumination apparatus comprising: a cover comprising a first portion and a second portion; and a light source disposed within the cover. An average thickness of the first portion is greater than that of the second portion.

In another embodiment of the present disclosure, an illumination apparatus is provided. The illumination apparatus comprises: a cover comprising a first portion and a second portion; and a light source disposed within the cover. A transmittance of the first portion is less than that of the second portion.

In another embodiment of the present disclosure, an illumination apparatus is provided. The illumination apparatus comprises: a cover comprising a chamber; and an inner cover disposed in the chamber and comprising an inner chamber; a light source disposed within the inner chamber. The cover and the inner cover comprise a plurality of diffuser particles, and a concentration of the diffuser particles within the cover and the inner cover is different.

BRIEF DESCRIPTION OF THE DRAWINGS

The accompanying drawings are included to provide easy understanding of the application, and are incorporated herein and constitute a part of this specification. The drawings illustrate the embodiments of the application and, together with the description, serve to illustrate the principles of the application.

DETAILED DESCRIPTION OF THE EMBODIMENTS

To better and concisely explain the disclosure, the same name or the same reference number given or appeared in different paragraphs or figures along the specification should has the same or equivalent meanings while it is once defined anywhere of the disclosure.

The following shows the description of the embodiments of the present disclosure in accordance with the drawings.

Figure 1:
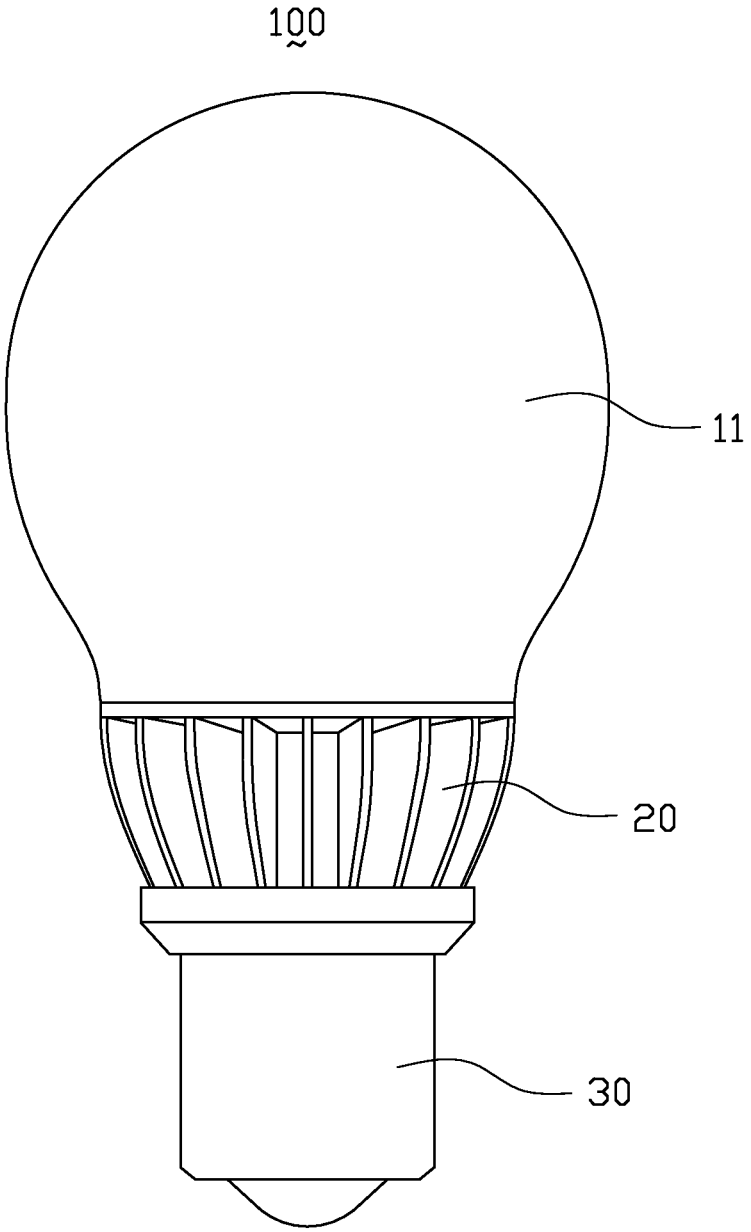
FIG. 1 shows a perspective view of an illumination apparatus in accordance with the first embodiment of the present disclosure.
Figure 2A:
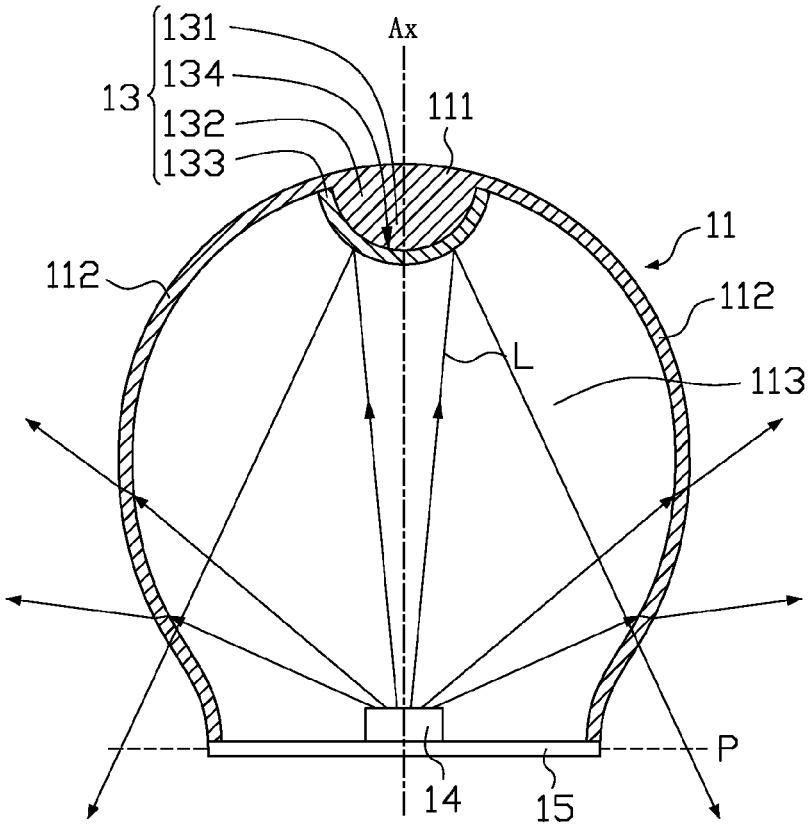
FIG. 2A is a cross-sectional view of a cover of the illumination apparatus in accordance with the first embodiment of the present disclosure.

FIGS. 1 and 2A disclose an illumination apparatus 100 according to the first embodiment of the present disclosure. The illumination apparatus 100 is a lamp bulb. The illumination apparatus 100 comprises a cover 11; a light source 14; a circuit unit 30 electrically connecting with the light source 14 for controlling the light source 14; and a heat sink 20 disposed between the cover 11 and the circuit unit 30 for conducting heat generated by the light source 14 away from the illumination apparatus 100.

Referring to FIG. 2A, the cover 11 comprises a first portion 111 and a second portion 112, and defines a chamber 113 therein. The light source 14 is disposed within the chamber 113. The first portion 111 is arranged in the center of the cover 11, and the second portion 112 surrounds the first portion 111 and symmetrically extends from the first portion 111 in the opposite direction. In one embodiment, the first portion 111 and the second portion 112 comprise the same material. In this embodiment, the first portion 111 of the cover 11 comprises a protrusion 13 extending therefrom and toward the light source 14 such that the first portion 111 has an average thickness greater than that of the second portion 112. In one embodiment, the average thickness of the first portion 111 is at least two times greater than that of the second portion 112. The protrusion 13 of the first portion 111 has a curved surface 134 facing the light source 14 for defining an inner surface and has an area in a plane view larger than that of the light source 14. In this embodiment, the protrusion 13 has a semi-circular shape in cross-section such that the first portion 111 has a non-uniform thickness where a central portion 131 of the first portion 111 is thicker than a peripheral portion 132 of the first portion 111. In contrary, the second portion 112 has a substantially uniform thickness. Since the average thickness of the first portion 111 is greater than that of the second portion 112, the transmittance of the first portion 111 is less than that of the second portion 112, which results in some light emitted from the light source 14 are reflected by the first portion 111. By virtue of the thickness difference between the first and second portions 111, 112, an omni-directional light pattern can be achieved. In one embodiment, less than 80% of the light emitted by the light source 14 is transmitted through the first portion 111, and more than 80% of the light emitted by the light source 14 is transmitted through the second portion 112. In addition, the first and second portions 111, 112 comprise a plurality of diffuser particles dispersed therein, such as $TiO_2$, $SiO_2$, or air. The more the diffuser particles are, the less the transmittance of the first and second portions 111, 112 is.

The illumination apparatus 100 further comprises a holder 15 supporting the light source 14 and connected with the cover 11. The holder 15 is disposed between the cover 11 and the heat sink 20, and the light source 14 is directly disposed on/above the holder 15. In another embodiment, the light source 14 is disposed within the center of the chamber 113 and is supported by the holder 15 through a post (not shown). The holder 15 and the post have heat dissipation properties such that heat generated by the light source 14 can be conducted to the heat sink 20 therethrough.

Figure 2B:
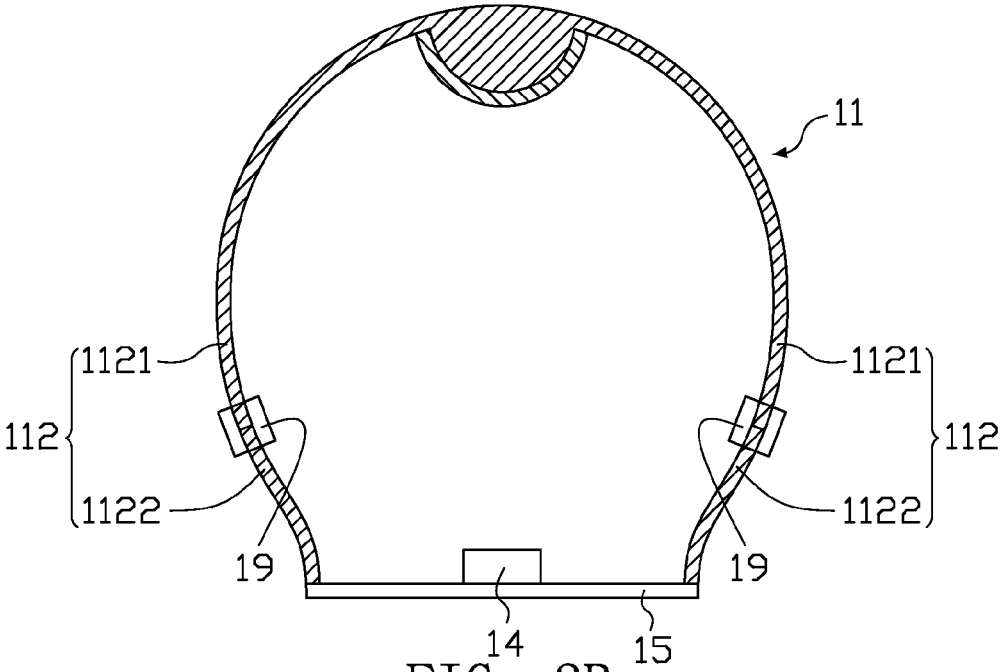
FIG. 2B is a cross-sectional view of the cover of the illumination apparatus in accordance with the first embodiment of the present disclosure, showing a connecting means.

In this embodiment, the protrusion 13 and the cover 11 (the first portion 111 and the second portion 112) comprise the same material and are formed by molding such as injection molding, thereby monolithically integrating with each other to form a single-piece object. The "monolithically integrating" means that there is no boundary existing between the protrusion 13 and the cover 11. It is noted that, as shown in FIG. 2B, the second portion 112 comprises an upper part 1121 extending from the first portion 111 and a lower part 1122 downwardly extending from the upper part 1121. The holder 15 is connected with the lower part 1122. In one embodiment, the upper part 1121 and the lower part 1122 of the second portion 112 are formed as two separate pieces and combined using a connecting means 19 which is arranged close to the holder 15, as shown in FIG. 2B. Alternatively, the connecting means 19 can be arranged in the central position of the cover 11 (not shown). The connecting means 19 comprises screw, fasteners, buckles, or clips. In another embodiment, the upper part 1121 and the lower part 1122 are formed as a one-piece member. The cover 11 comprises glass or polymer, such as polyurethane (PU), polycarbonate (PC), polymethylmethacrylate (PMMA), or polyethylene (PE). The protrusion 13 can be solid or hollow.

Figure 3:
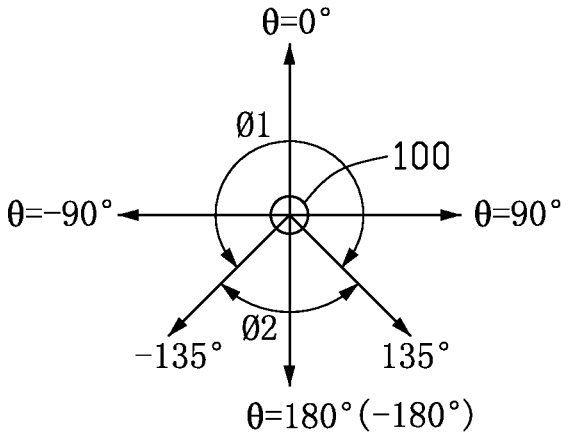
FIG. 3 is a coordinate system to describe the spatial distribution of illumination emitted by the illumination apparatus.

Moreover, referring to FIG. 2A, the protrusion 13 further comprises a reflective coating 133 formed on the inner surface. Therefore, when the light emitted by the light source 14 passes toward different directions as indicated by the arrow L, some of the light passes through the second portion 112 and exits the cover 11, and some of the light emitting toward the protrusion 13 is substantially reflected by the reflective coating 133 and is directed downwardly to exit the cover 11 such that some light exist under the plane (P). The light source 14 has an optical axis (Ax, $\theta=0°$ as shown in FIG. 3). The plane (P, $\theta=90°$ as shown in FIG. 3) is a horizontal plane orthogonal to the optical axis and is coplanar with the holder 15 on which the light source 14 is disposed. Specifically, as shown in FIG. 3, a coordinate system is used to describe the spatial distribution of the illumination emitted by the light source 14 or the illumination apparatus 100. A direction of the illumination is described by a coordinate $\theta$ in a range [0°, 180°]. By virtue of the protrusion 13 comprising the reflective coating 133 formed thereon or by virtue of the thickness difference between the first and second portions 111, 112, the direction of the illumination emitted by the illumination apparatus 100 is in a range from 135° to −135° ($\phi_1=270°$) for achieving an omni-directional light pattern. It is noted that "omni-directional light pattern" means more than 5% of the light emitted by the light source 14 is existing in the range from −135° to 135° ($\phi_2=90°$). The "substantially reflected" means more than 90% of the light emitted by the light source 14 is reflected by the reflective coating 133 and less than 10% of the light emitted by the light source 14 is transmitted through the first portion 111. In one embodiment, the reflective coating 133 can be formed on an outer surface opposite to the inner surface. The reflective coating 133 comprises paint with silver or aluminum. Alternatively, the reflective coating 133 can be a reflective layer (not shown) including a plurality of sub-layers formed as a Distributed Bragg Reflector (DBR). In another embodiment, the protrusion 13 comprises a rough surface, such as a nanostructure for scattering the light.

Figure 4A:
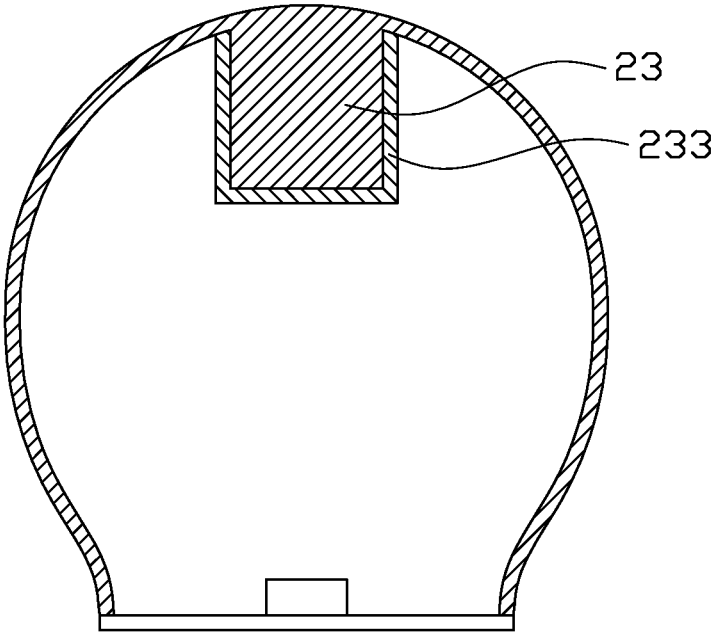
FIGS. 4A to 4F shows covers with various shapes.
Figure 4B:
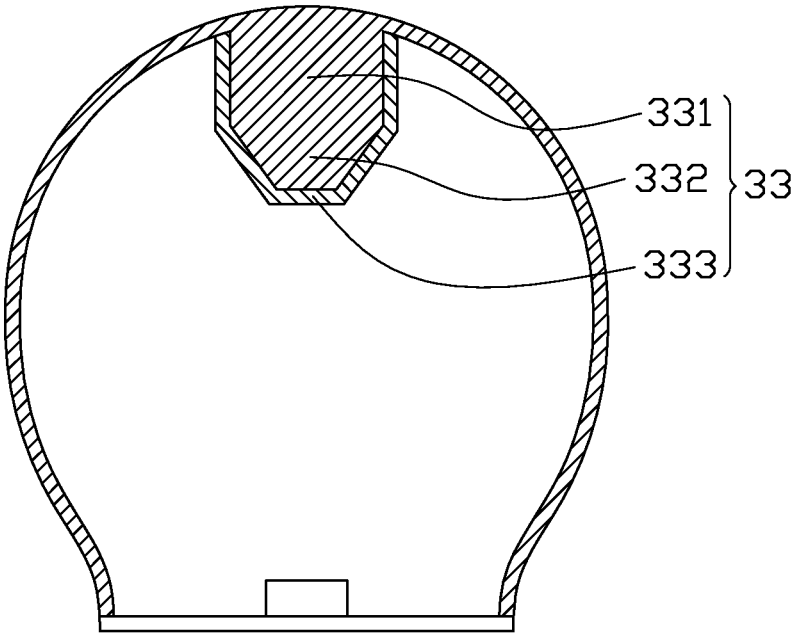
Figure 4C:
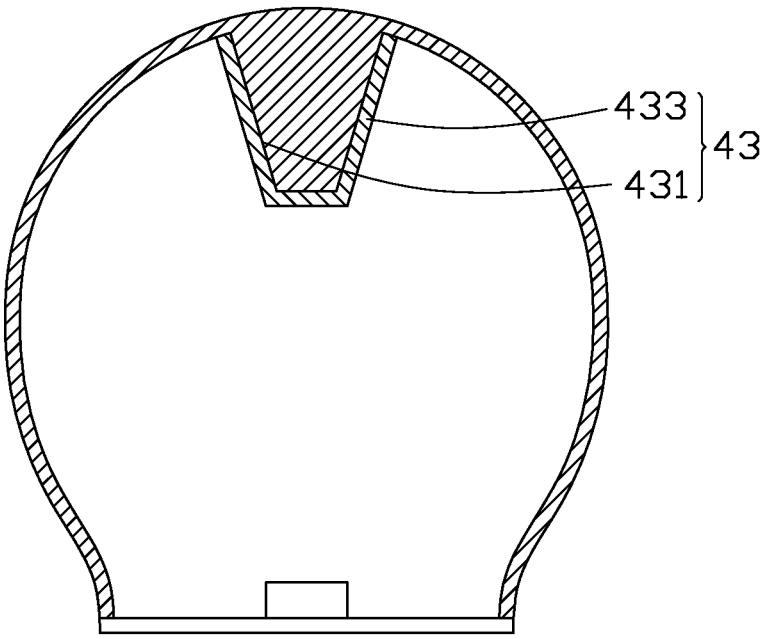
Figure 4D:
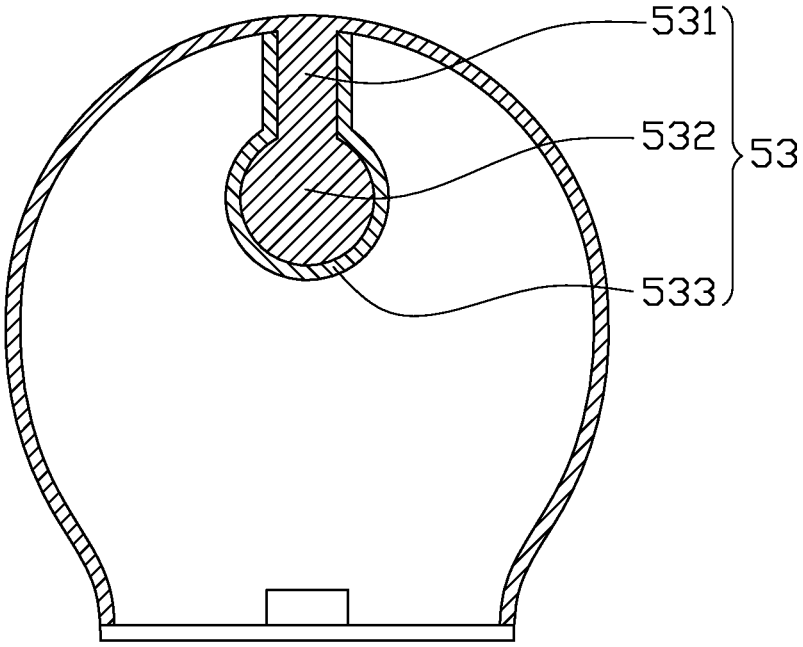
Figure 4E:
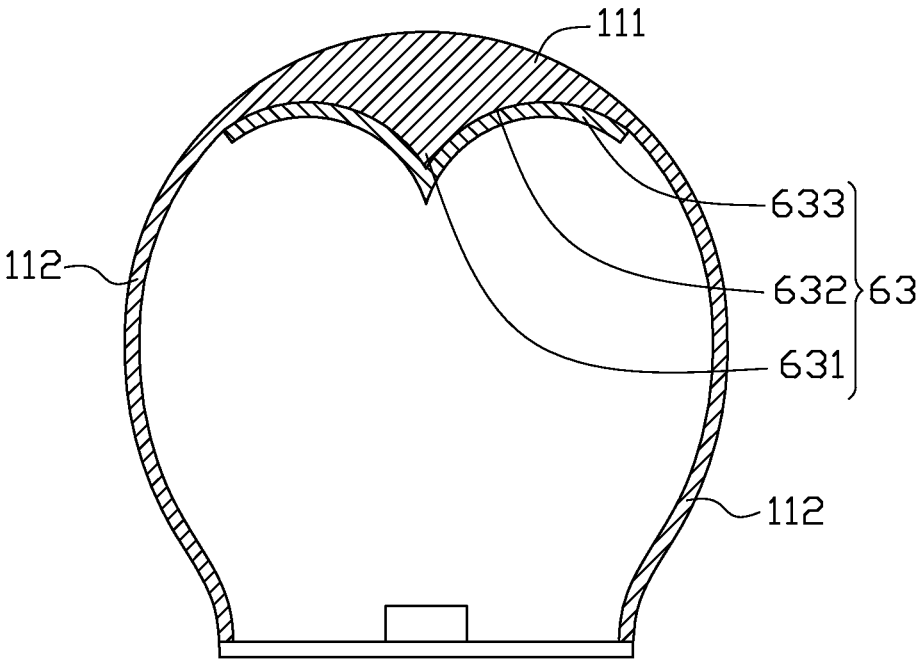
Figure 4F:
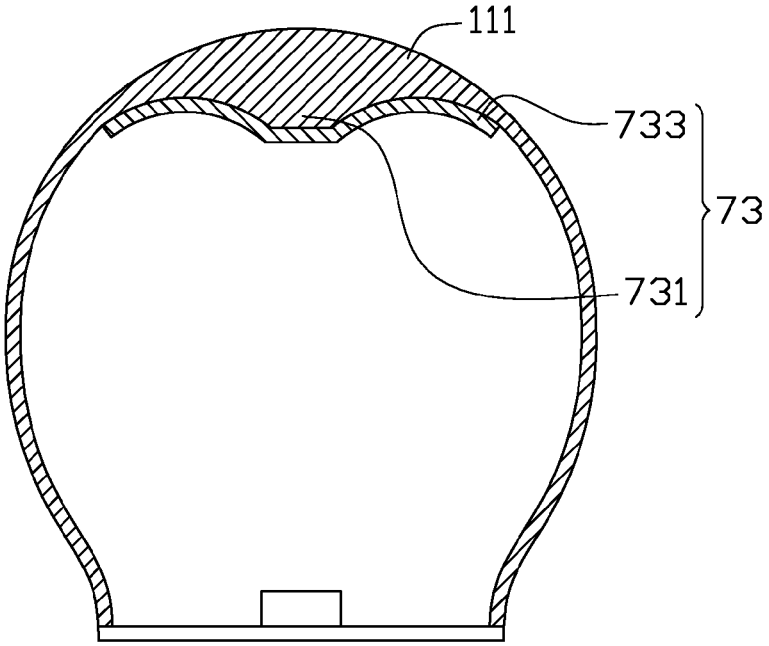

FIGS. 4A to 4F disclose the cover with various shapes. Referring to FIG. 4A, the protrusion 23 has a rectangular shape in cross-section and comprises the reflective coating 233 formed thereon. Referring to FIG. 4B, the protrusion 33 comprises a first section 331 having a rectangular shape in cross-section, and a second section 332 extending from the first section 331 toward the light source and having a truncated shape in cross-section. In addition, the reflective coating 333 is formed on the first and second sections 331, 332 of the protrusion 33. Referring to FIG. 4C, the protrusion 43 comprises two inclined sidewalls 431 and has a trapezoidal shape in cross-section. The protrusion 43 further comprises the reflective coating 433 formed thereon. Referring to FIG. 4D, the protrusion 53 comprises a first part 531 having a rectangular shape in cross-section, and a second part 532 extending from the first part 531 toward the light source and having a circular shape in cross-section. Likewise, the protrusion 53 further comprises the reflective coating 533 formed thereon. Referring to FIG. 4E, the protrusion 63 comprises a tip 631 corresponding to the center of the first portion 111, and two curved surface 632 divergently extending from the tip 631. The protrusion 63 further comprises the reflective coating 633 formed thereon. Referring to FIG. 4F, the protrusion 73 has a similar structure to that in FIG. 4E, except that the protrusion 73 has a flat surface 731 corresponding to the center of the first portion 111. The protrusion 73 further comprises the reflective coating 733 formed thereon.

Figure 5:
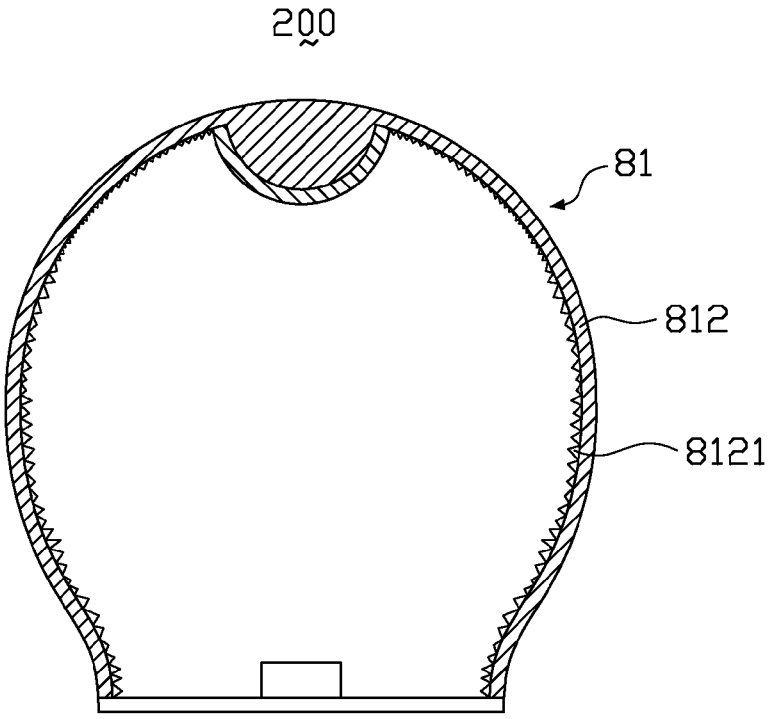
FIG. 5 is a cross-sectional view of the cover of the illumination apparatus in accordance with the second embodiment of the present disclosure.

FIG. 5 discloses a cover of an illumination apparatus 200 according to the second embodiment of the present disclosure. The second embodiment of the illumination apparatus 200 has the similar structure with the first embodiment of the illumination apparatus 100. In this embodiment, the second portion 812 of the cover 81 comprises a rough surface 8121, such as a nanostructure for scattering the light. It is noted that the rough surface 8121 can be provided in portions of the second portion 812.

Figure 6:
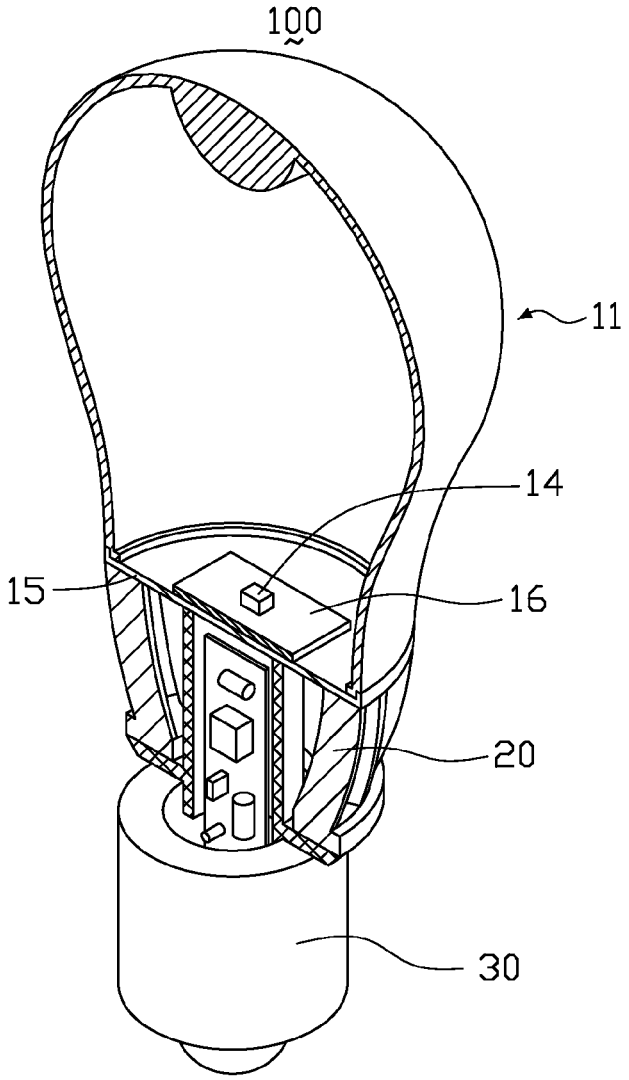
FIG. 6 is a schematic cross-sectional view of the illumination apparatus in accordance with the first embodiment of the present disclosure.
Figure 7:
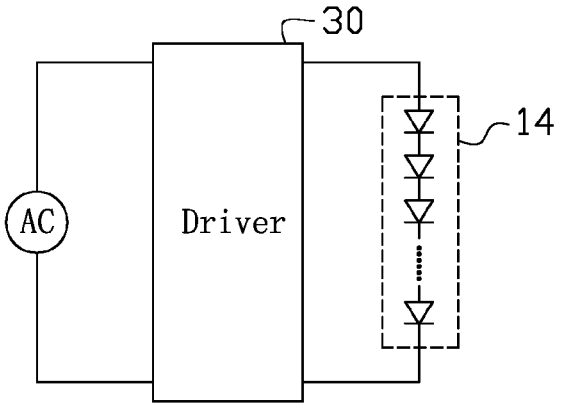
FIG. 7 is a circuit diagram of the illumination apparatus in accordance with the first embodiment of the present disclosure.

FIG. 6 discloses a perspective view of the illumination apparatus 100 as shown in FIG. 1. The light source 14 is electrically connected with a board 16, such as PCB board, which is disposed on the holder 15. FIG. 7 shows a circuit diagram of the circuit unit 30. The circuit unit 30 comprises a bridge rectifier (not shown) electrically connected with a power source which provides an alternating current signal for receiving and regulating the alternating current signal into a direct current signal. In this embodiment, the light source 14 comprises a plurality of light-emitting diodes connected in series with each other. Alternatively, the light-emitting diodes can be connected in parallel or series-parallel with each other. The light source 14 can comprise the light-emitting diodes with the same wavelength. In one embodiment, the light source 14 comprises the light-emitting diodes with different wavelengths such as red, green and blue light-emitting diodes for color mixing, or a wavelength converter formed on the light-emitting diodes for generating a converted light having a wavelength different from the wavelength of the light emitting from the light source 14. In one embodiment, the light source 14 can be a point light source, a planar light source, or a linear light source which comprises a plurality of light-emitting diodes arrange in a line.

Figure 8A:
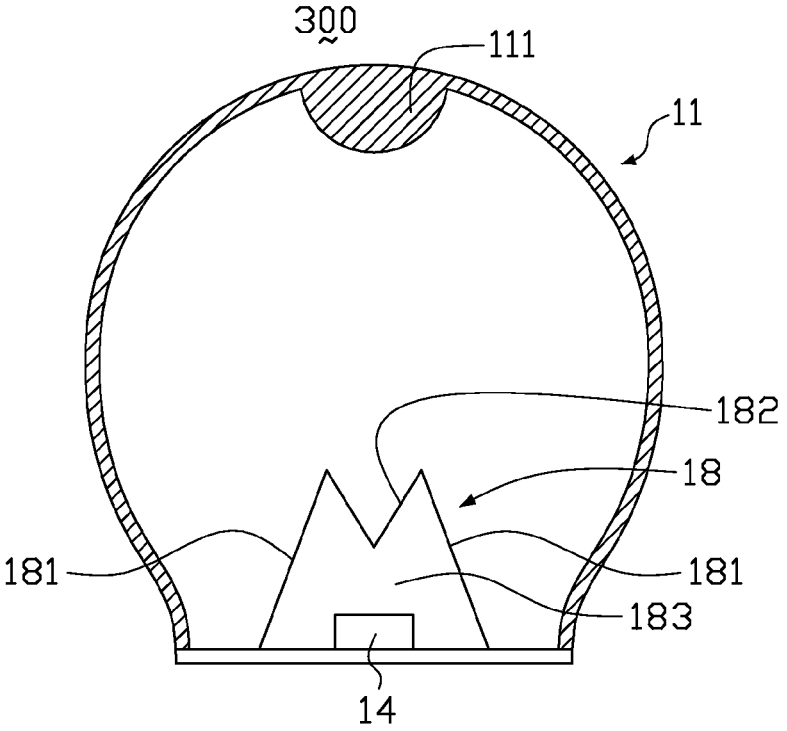
FIG. 8A is a cross-sectional view of the cover of the illumination apparatus in accordance with the third embodiment of the present disclosure.

FIG. 8A discloses a cover of an illumination apparatus 300 according to the third embodiment of the present disclosure. The third embodiment of the illumination apparatus 300 has the similar structure with the first embodiment of the illumination apparatus 100. The illumination apparatus 300 further comprises an inner cover 18 which is disposed in the chamber 113 and which is formed above the light source 14. The inner cover 18 defines an inner chamber 183 therein and the light source 14 is disposed within the inner chamber 183. In this embodiment, the inner cover 18 comprises two slanted sidewalls 181, and a concave portion 182 extending between the sidewalls 181 and monolithically integrating with the slanted sidewalls 181. The concave portion 182 has a triangular shape in cross-section. In this embodiment, more than 80% of the light emitted by the light source 14 is transmitted through the inner cover 18 toward the protrusion 111 of the cover 11 and is reflected by the protrusion 111, thereby achieving the omni-directional light pattern. In addition, the first portion 111 has an area larger than that of the inner cover 18 in a plan view. The inner cover 18 is hollow and spaced apart from the light source 14. The inner cover 18 comprises polymethylmethacrylate (PMMA), polycarbonate (PC), polyurethane (PU), or polyethylene (PE).

Figure 8B:
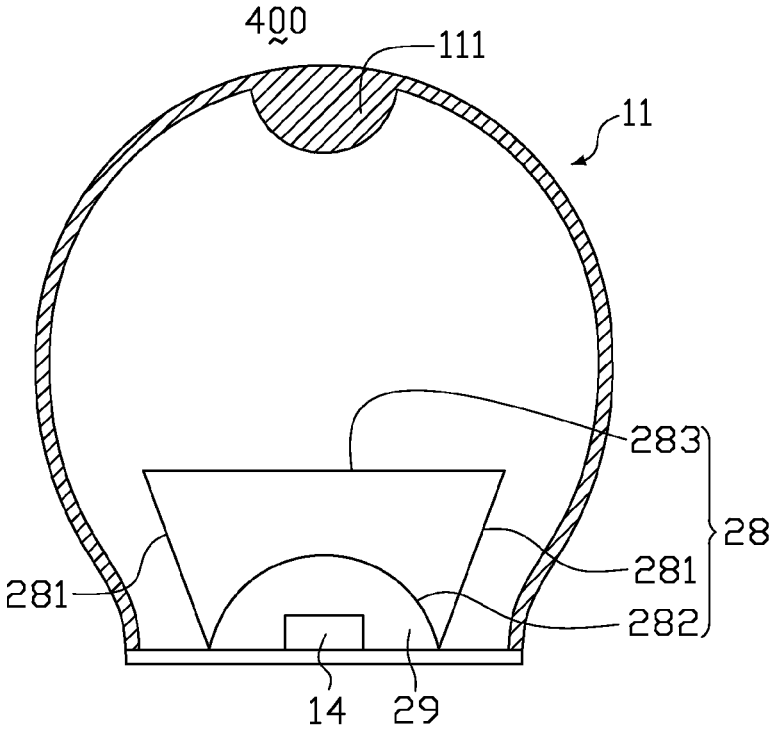
FIG. 8B is a cross-sectional view of the cover of the illumination apparatus in accordance with the fourth embodiment of the present disclosure.

FIG. 8B discloses a cover of an illumination apparatus 400 according to the fourth embodiment of the present disclosure. The fourth embodiment of the illumination apparatus 400 has the similar structure with the third embodiment of the illumination apparatus 300. The inner cover 28 comprises a convex portion 282, a plat surface 283 opposite to the convex portion 282, and two slanted sidewalls 281 extending between the convex portion 282 and the flat surface 283. The inner cover 28 is solid and there is an air gap 29 formed between the inner cover 28 and the light source 14. In one embodiment, a wavelength converter (not shown) is formed on the flat surface 283.

Figure 8C:
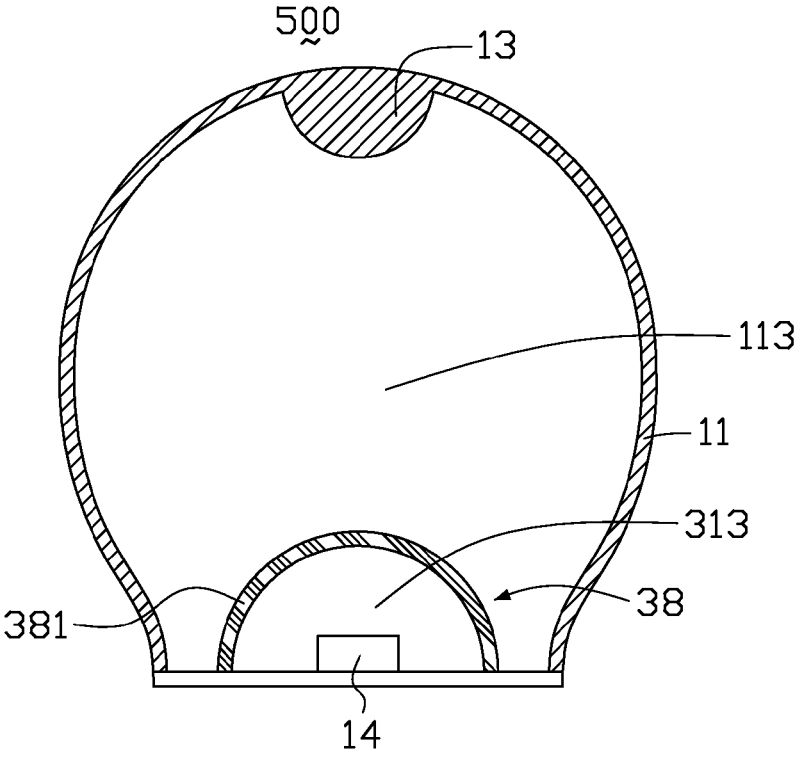
FIG. 8C is a cross-sectional view of the cover of the illumination apparatus in accordance with the fifth embodiment of the present disclosure.

FIG. 8C discloses a cover of an illumination apparatus 500 according to the fifth embodiment of the present disclosure. The fifth embodiment of the illumination apparatus 500 has the similar structure with the third embodiment of the illumination apparatus 300. The inner cover 38 is disposed in the chamber 113 and above the light source 14. The inner cover 38 defines an inner chamber 313 therein and the light source 14 is disposed within the inner chamber 313. The cover 11 and the inner cover 38 comprise a plurality of diffuser particles (not shown) therein. The more the diffuser particles are, the less the transmittance is. Accordingly, the concentrations of the diffuser particles within the cover 11 and the inner cover 38 are adjustable to be different for achieving the omni-directional light pattern. The diffuser particles comprise $TiO_2$, $SiO_2$, or air. In this embodiment, the inner cover 38 further comprises a wavelength converter 381 formed on an outer surface thereof facing the protrusion 13 for generating a converted light having a wavelength different from the wavelength of the light emitting from the light source 14.

Figure 8D:
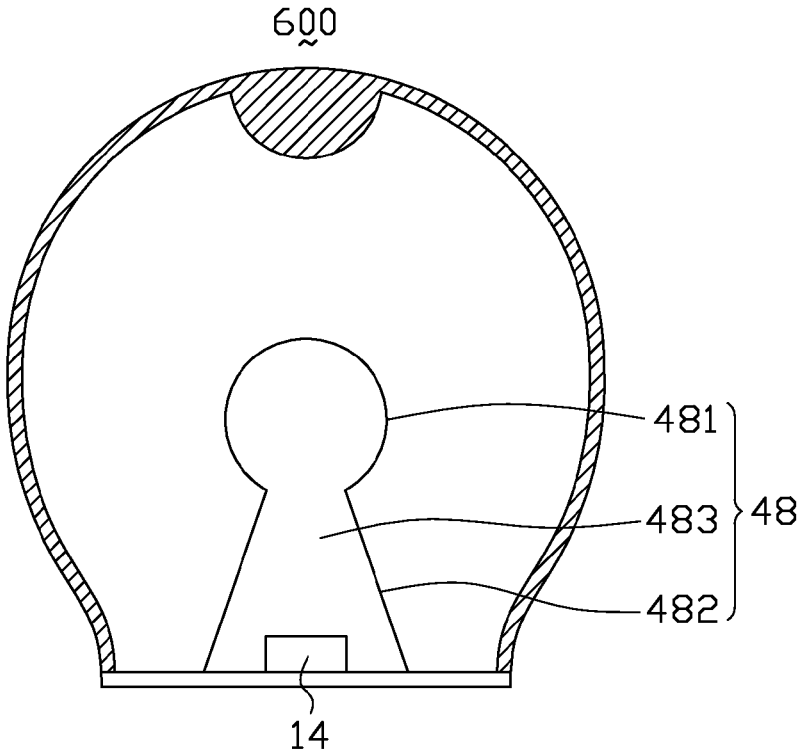
FIG. 8D is a cross-sectional view of the cover of the illumination apparatus in accordance with the sixth embodiment of the present disclosure.

FIG. 8D discloses a cover of an illumination apparatus 600 according to the sixth embodiment of the present disclosure. The sixth embodiment of the illumination apparatus 600 has the similar structure with the third embodiment of the illumination apparatus 300. The inner cover 48 comprises a first portion 481 having a sphere-like shape in cross-section and a second portion 482. The inner cover 48 is hollow and defines an inner chamber 483 therein. The light source 14 is disposed within the inner chamber 483. The second portion 482 is made of Ag or Al for reflecting the light emitted from the light source 14. Alternatively, the second portion 482 comprises a reflective coating such as Ag or Al formed thereon.

Figure 9A:
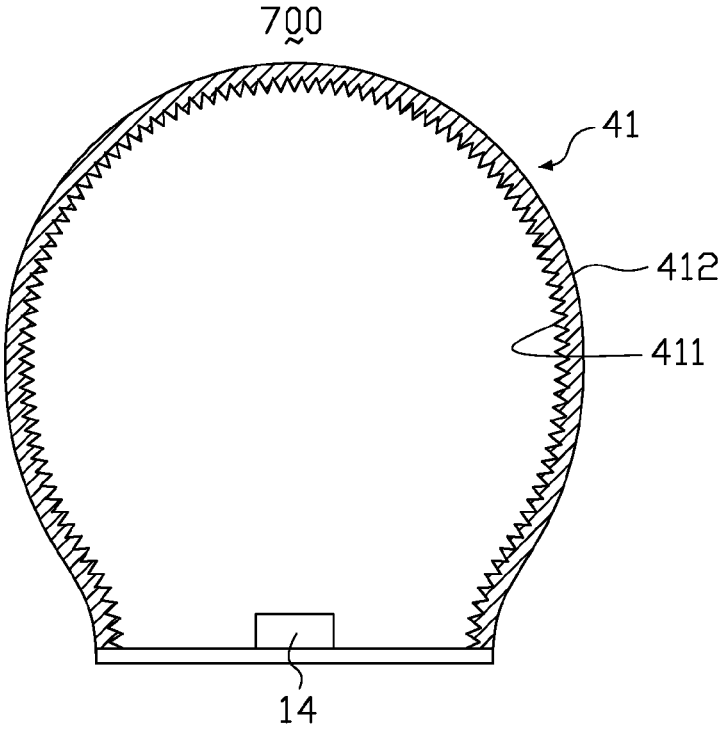
FIG. 9A is a cross-sectional view of the cover of the illumination apparatus in accordance with the seventh embodiment of the present disclosure.

FIG. 9A discloses a cover of an illumination apparatus 700 according to the seventh embodiment of the present disclosure. The cover 41 comprises a rough structure formed on the inner surface 411, and a smooth outer surface 412 opposite to the inner surface 411. The cover 41 comprises plastic such as polymethylmethacrylate (PMMA), polycarbonate (PC), polyurethane (PU), polyethylene (PE), or glass. In this embodiment, the rough structure is formed by sand blasting, injection molding, polishing, or wet etching using an etchant such as acetone, ethyl acetate, or monomethyl ether acetate. In this embodiment, the rough structure has a uniform roughness density on the entire inner surface 411.

Figure 9B:
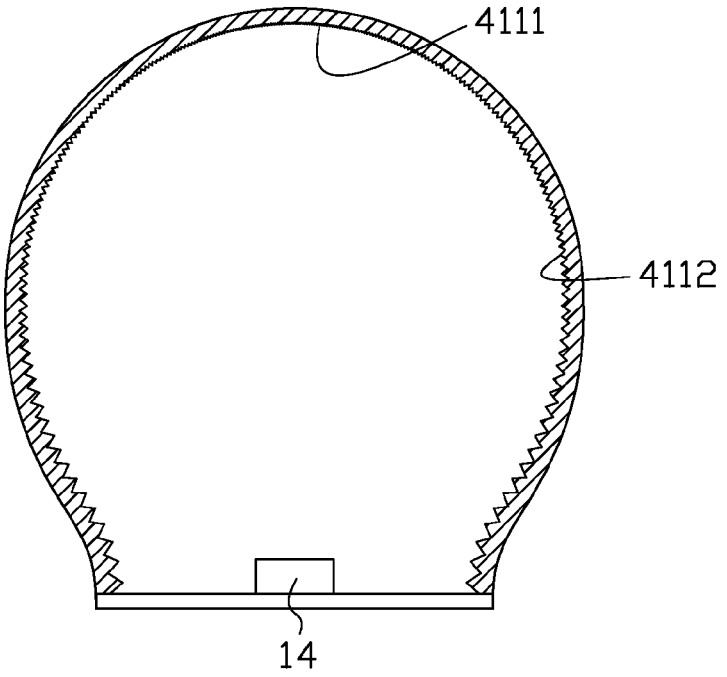
FIG. 9B is a cross-sectional view of the cover of the illumination apparatus in accordance with the seventh embodiment, showing different roughness density.

Alternatively, as shown in FIG. 9B, the roughness density is different on the inner surface 411, that is, the rough structure comprising a gradient in the roughness density from a central part 4111 to a peripheral part 4112 of the cover 41. Due to the difference of the roughness density, the light emitted from the light source 14 is scattered more at the central part 4111 than that at the peripheral part 4112. The roughness density is defined by a haze (H) value. The definition of haze is a ratio of scattering light (S) to the total light (scattering light (S)+transmitted light (T)). The haze value of the central part 4111 ranges from 0.5 to 0.9. The haze value of the peripheral part 4112 ranges from 0.3 to 0.6.

Figure 10A:
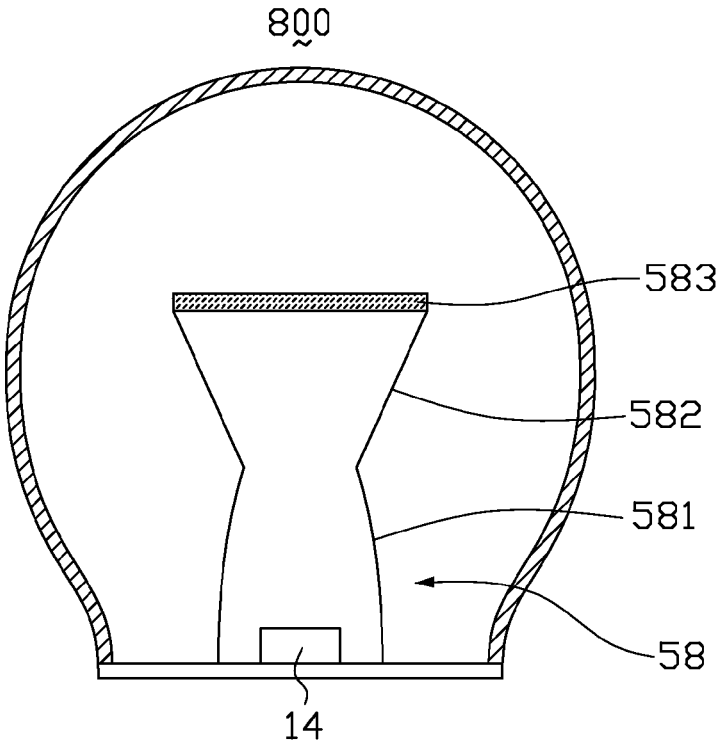
FIG. 10A is a cross-sectional view of the cover of the illumination apparatus in accordance with the eighth embodiment of the present disclosure.

FIG. 10A discloses a cover of an illumination apparatus 800 according to the eighth embodiment of the present disclosure. The eighth embodiment of the illumination apparatus 800 has the similar structure with the sixth embodiment of the illumination apparatus 600. The inner cover 58 comprises a first light-guiding portion 581, and a second light-guiding portion 582. The first light-guiding portion 581 has a barrel-like shape in cross-section for efficiently guiding the light emitting from the light source 14 toward the second light-guiding portion 582. The inner cover 58 further comprises a wavelength converter 583 formed on the second light-guiding portion 582 for generating a converted light having a wavelength different from the wavelength of the light emitting from the light source 14. The second light-guiding portion 582 has a trapezoidal shape in cross-section for reflecting the light from the first light-guiding portion 581 toward the wavelength converter 583. When the light emitted from the light source 14 through the first and second light-guiding portions 581, 582 toward the wavelength converter 583, the light is converted and scattered by particles dispersed in the wavelength converter 583 such that the light is upwardly and downwardly transmitted through the cover 11 so as to achieve the omni-directional light pattern. In this embodiment, the first light-guiding portion 581 and the second light-guiding portion 582 comprise the same material, such as PMMA, PC, silicon, or glass.

Figure 10B:
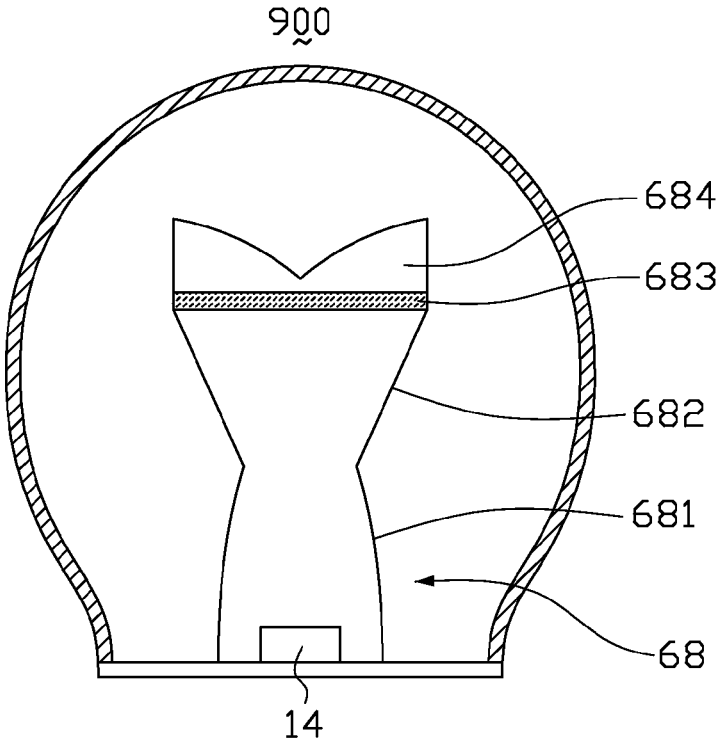
FIG. 10B is a cross-sectional view of the cover of the illumination apparatus in accordance with the ninth embodiment of the present disclosure.

FIG. 10B discloses a cover of an illumination apparatus 900 according to the ninth embodiment of the present disclosure. The ninth embodiment of the illumination apparatus 900 has the similar structure with the eighth embodiment of the illumination apparatus 800. The inner cover 68 further comprises a third light-guiding portion 684_formed on the wavelength converter 683 such that the wavelength converter 683 is sandwiched between the second light-guiding portion 682 and the third light-guiding portion 684. The third light-guiding portion 684 comprises two curved surfaces for reflecting the light toward a lateral direction. The first, second, and third light-guiding portions 681, 682, and 684 can be solid or hollow.

Figure 10C:
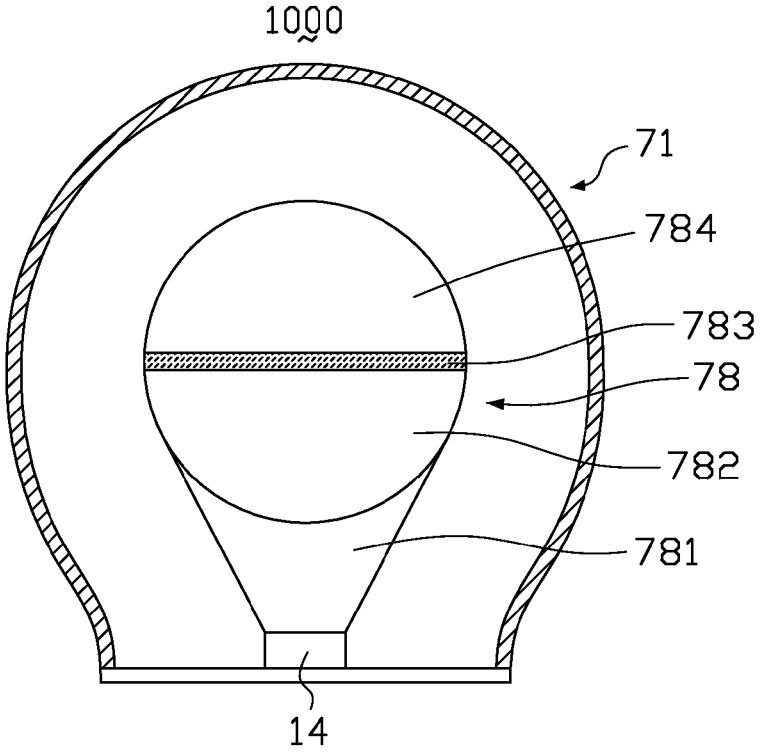
FIG. 10C is a cross-sectional view of the cover of the illumination apparatus in accordance with the tenth embodiment of the present disclosure.

FIG. 10C discloses a cover of an illumination apparatus 1000 according to the tenth embodiment of the present disclosure. The tenth embodiment of the illumination apparatus 1000 has the similar structure with the ninth embodiment of the illumination apparatus 900 and comprises the first, second, and third light-guiding portions 781, 782, 784. The first light-guiding portion 781 has a trapezoidal-like shape in cross-section for guiding the light toward the second light-guiding portion 782. Each of the second and third light-guiding portions 782, 784 has a semi-circular shape in cross-section. The wavelength converter 783 is sandwiched between the second light-guiding portion 782 and the third light-guiding portion 784. Due to the shape of the second and third light-guiding portions 782, 784, a total reflection occurred at the interface between the light-guiding portions 782, 784 and air can be reduced. Likewise, when the light emitted from the light source 14 through the first and second light-guiding portions 781, 782 toward the wavelength converter 783, the light is converted and scattered by particles dispersed in the wavelength converter 883 such that the light is upwardly and downwardly transmitted through the cover 71 so as to achieve the omni-directional light pattern.

Figure 10D:
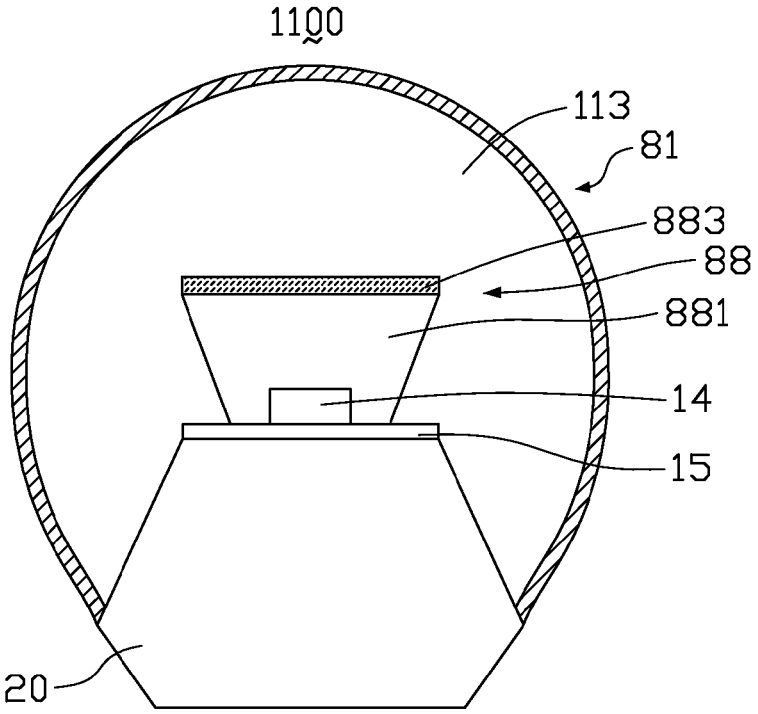
FIG. 10D is a cross-sectional view of the cover of the illumination apparatus in accordance with the eleventh embodiment of the present disclosure.

FIG. 10D discloses a cover of an illumination apparatus 1100 according to the eleventh embodiment of the present disclosure. The heat sink 20 extends into the chamber 113 of the cover 81, and the light source 14 is disposed in the center of the chamber 113. The inner cover 88 is formed above the light source 14 and comprises a light-guiding portion 881 and a wavelength converter 883 formed on the light-guiding portion 881. Because of the position of the light source 14 (in the center of the chamber 113), when the light emitted from the light source 14 toward the wavelength converter 883, the light is scattered by particles dispersed in the wavelength converter 883 such that light is upwardly and downwardly transmitted through the cover 81 so as to achieve the omni-directional light pattern.

Figure 11:
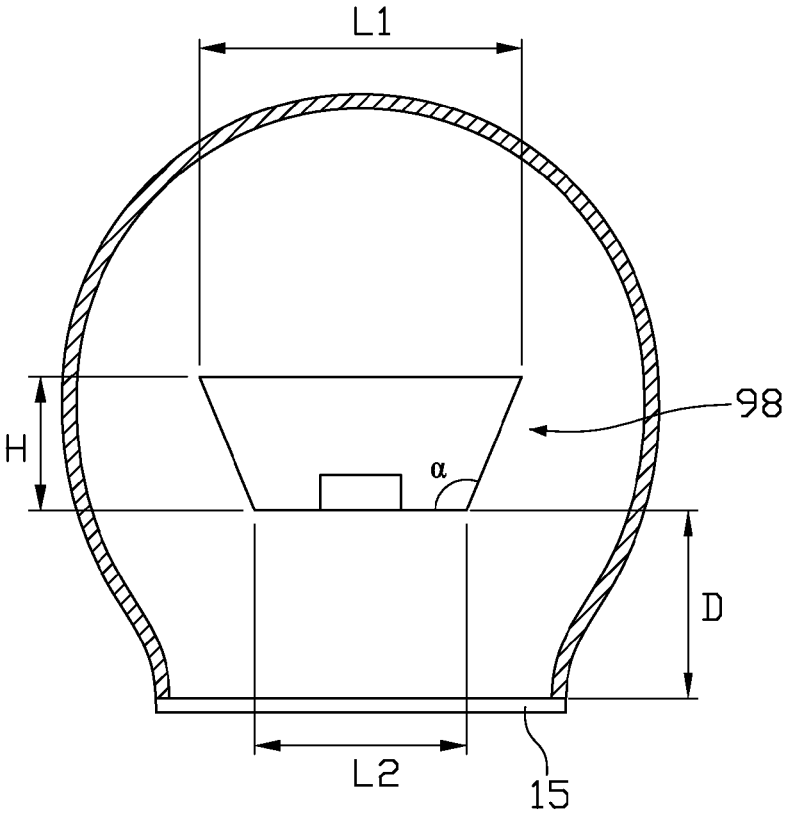
FIG. 11 is a cross-sectional view of the inner cover.
Figure 12A:
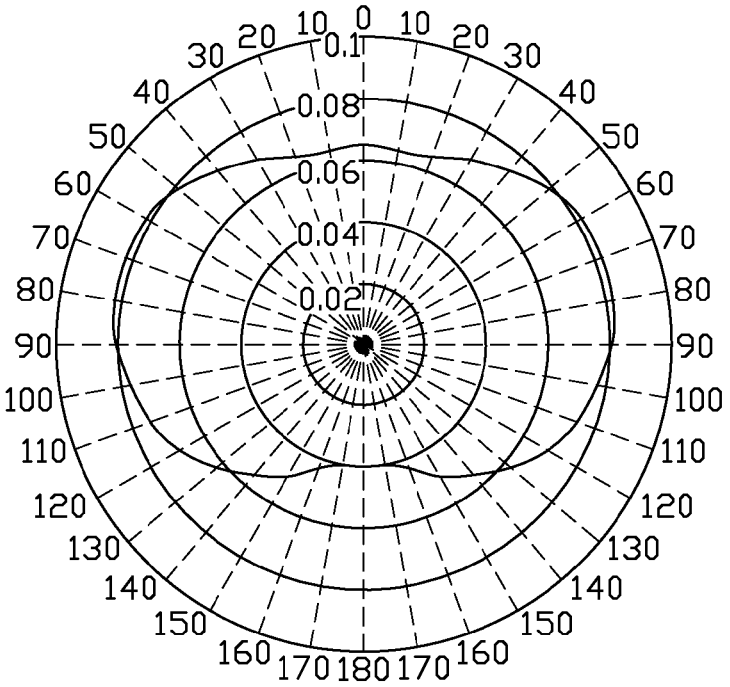
FIGS. 12A to 12E show simulated luminous intensity distributions at different distances (D).
Figure 12B:
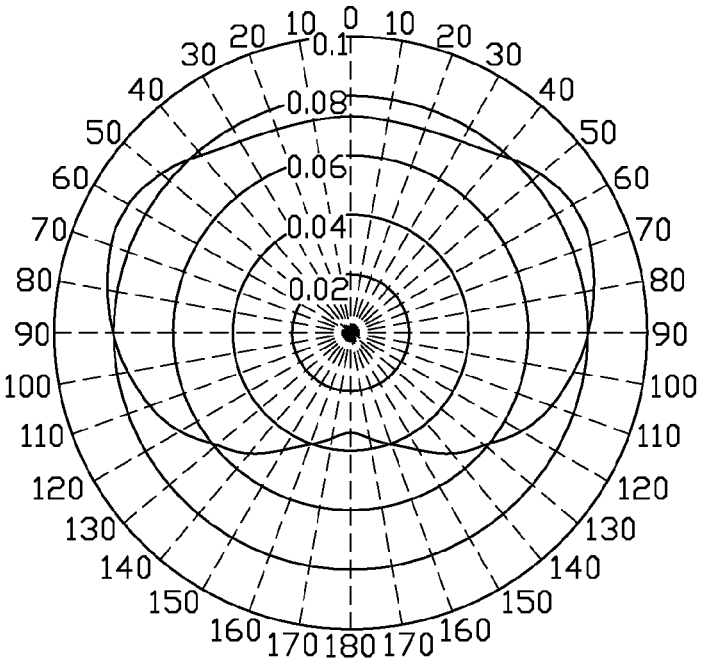
Figure 12C:
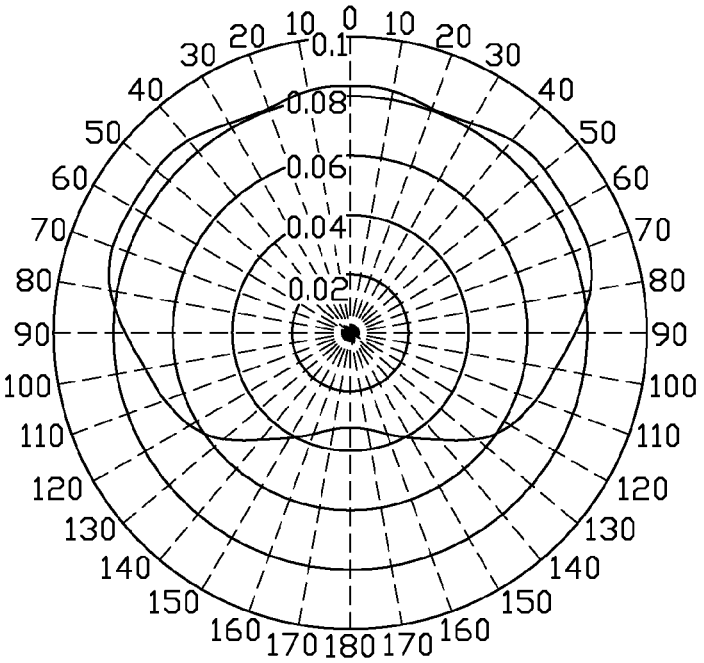
Figure 12D:
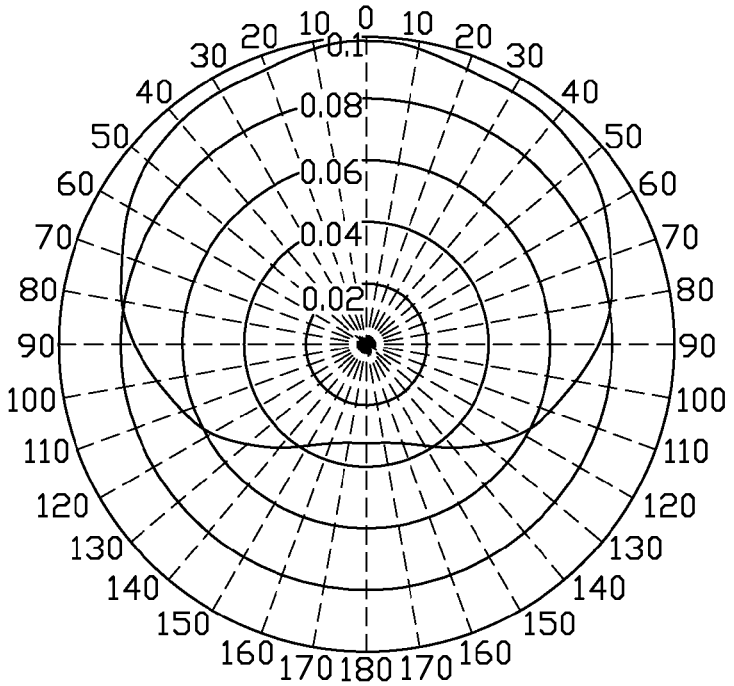
Figure 12E:
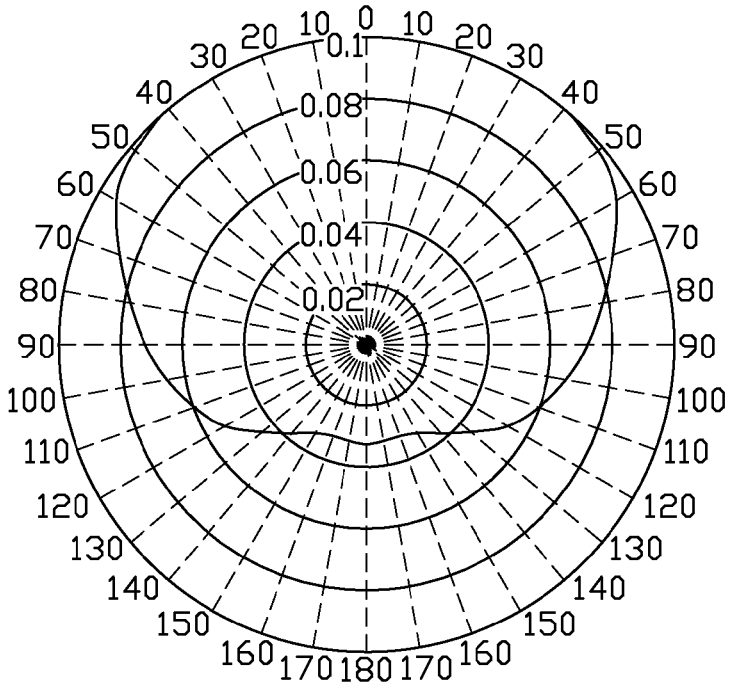

Referring to FIG. 11, the inner cover 98 has a trapezoidal shape including a top surface having a first length (L1), a bottom surface having a second length (L2), and a height (H). The ratio of the first length (L1) to the second length (L2) is greater than 2 and the ratio of the height (H) to the second length (L2) ranges from 1 to 1.5 for achieving the omni-directional light pattern. The height (H) is in a range of 3-9 mm. The bottom surface is inclined with respect to the height at an angle ($\alpha$) ranging from 106° to 132.5°. FIGS. 12A to 12E show simulated luminous intensity distributions at different distances (D) from the light source 14 to the holder 15, as shown in FIG. 11. The distances (D) shown in FIGS. 11A to 11E are 0 cm, 5 cm, 10 cm, 15 cm, and 20 cm, respectively. When the distance (D) is larger, the light intensity in the direction in a range from 0° to 90° is greater.

Figure 13A:
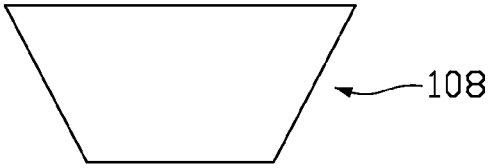
FIGS. 13A to 13C show different shapes of the inner cover.
Figure 13B:
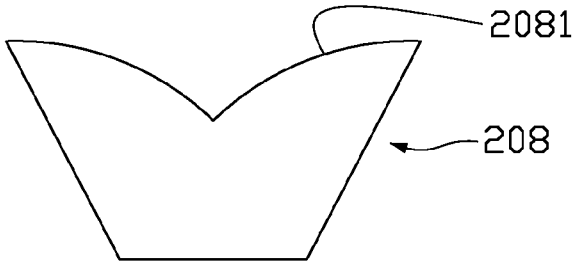
Figure 13C:
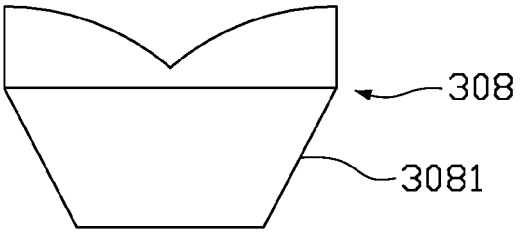
Figure 14A:
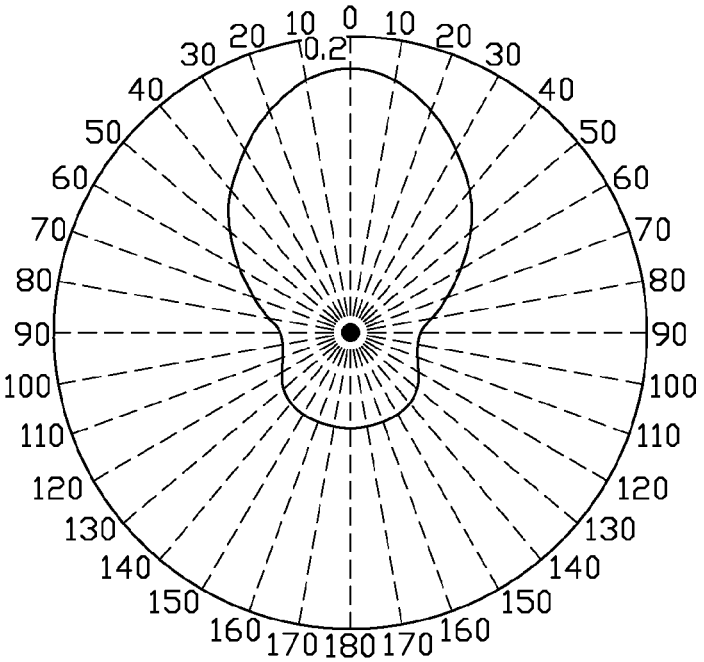
FIGS. 14A to 14C are simulated luminous intensity distributions.
Figure 14B:
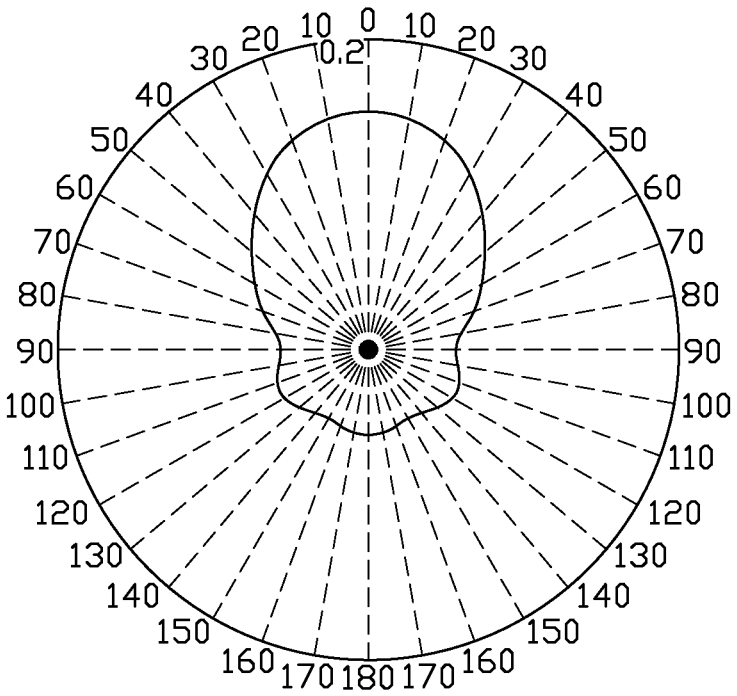
Figure 14C:
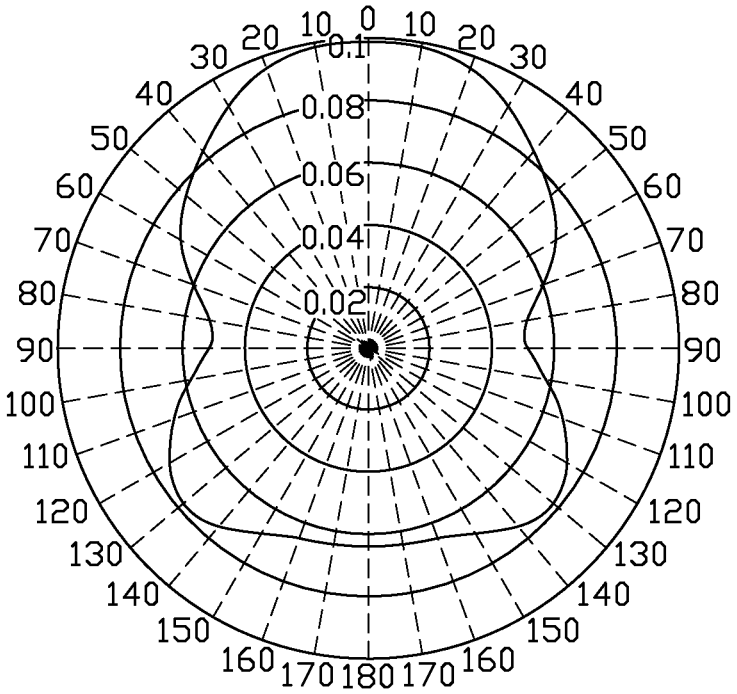

FIGS. 13A to 13C show different shapes of the inner cover. FIGS. 14A to 14C show simulated luminous intensity distributions when the inner cover has different shapes as shown in FIGS. 13A to 13C, respectively. When the inner cover 208 as shown in FIG. 13B comprises a cavity having two curved or inclined surfaces 2081, the light intensity in the direction in a range from 110° to 130° is greater than the inner cover 108 shown in FIG. 13A. Moreover, when the inner cover 308 further comprises a light-guiding portion 3081, the light intensity in all directions is greater than the inner cover 108 shown in FIG. 13A, for achieving the omni-directional light pattern.

It will be apparent to those having ordinary skill in the art that various modifications and variations can be made to the devices in accordance with the present disclosure without departing from the scope or spirit of the disclosure. In view of the foregoing, it is intended that the present disclosure covers modifications and variations of this disclosure provided they fall within the scope of the following claims and their equivalents.

What is claimed is:

1. An illumination apparatus comprising:

an outer cover comprising an inner surface and a plurality of diffuser particles of a first concentration;

a light source comprising a lateral surface, an upper surface, and a bottom surface;

a transparent inner cover arranged to space apart from the outer cover and dispose on the lateral surface and the upper surface, and comprising a plurality of diffuser particles of a second concentration which is different from the first concentration;

a wavelength converter disposed on the light source and spatially isolated from the outer cover; and a reflective layer, separated from the transparent inner cover, directly formed on the inner surface, and only covering the upper surface in a configuration of being arranged only above the upper surface and beneath the outer cover.

2. The illumination apparatus of claim 1, wherein the transparent inner cover has an upper surface which is convex.

3. The illumination apparatus of claim 1, wherein the wavelength converter is arranged between the light source and the transparent inner cover.

4. The illumination apparatus of claim 1, wherein the wavelength converter is arranged on the transparent inner cover.

5. The illumination apparatus of claim 1, wherein the transparent inner cover is formed in a trapezoidal shape with a wider top surface.

6. The illumination apparatus of claim 1, wherein the transparent inner cover has a slanted sidewall.

7. The illumination apparatus of claim 1, wherein the outer cover surrounds the transparent inner cover and the light source substantially in a symmetrical configuration.

8. The illumination apparatus of claim 1, wherein at least one of the plurality of diffuser particles comprises a material of $TiO_2$, $SiO_2$, or air.

9. The illumination apparatus of claim 1, wherein the outer cover comprises a material of polymer or glass.

10. The illumination apparatus of claim 1, further comprising a chamber arranged between the light source and the transparent inner cover.

11. The illumination apparatus of claim 1, wherein the transparent inner cover has a non-flat upper surface.

12. The illumination apparatus of claim 1, further comprising a heatsink disposed on the bottom surface of the light source.

13. The illumination apparatus of claim 12, wherein the heatsink is wider than the light source.

14. The illumination apparatus of claim 12, wherein the heatsink is wider than the transparent inner cover.

15. The illumination apparatus of claim 1, wherein the reflective layer is wider than the upper surface.

* * * * *